US005967887A

United States Patent [19]

Synowski

[11] Patent Number: 5,967,887

[45] Date of Patent: Oct. 19, 1999

[54] POLISHING AND BUFFING ATTACHMENT

[76] Inventor: Randy R. Synowski, 2322 Buckner St., Petersburg, Va. 23805

[21] Appl. No.: 09/048,663

[22] Filed: Mar. 26, 1998

[51] Int. Cl.[6] ..... B24B 23/00

[52] U.S. Cl. ..... 451/358; 451/533; 451/544; 451/495

[58] Field of Search ..... 451/358, 533, 451/544, 495

[56] References Cited

U.S. PATENT DOCUMENTS 5,564,971 10/1996 Evensen ..... 451/504
5,662,515 9/1997 Evensen ..... 451/59

*Primary Examiner*—David A. Scherbel
*Assistant Examiner*—Shantese McDonald

[57] ABSTRACT

A new polishing and buffing attachment for applying polish and buffing of objects, especially wheel rims. The inventive device includes a head member having a outer padded layer. The first end of an elongate shank is extended into the interior of the head member from the second end of the head member such that the second end of the shank is outwardly extended from the second end of the head member. A cover member has an interior space and opposite first and second ends. The second end of the cover member has an opening into the interior space of the cover member. The head member is insertable through the opening of the second end of the cover member into the interior space of the cover member such that the second end of the shank member extends outwards from the opening of the second end of the cover member.

17 Claims, 2 Drawing Sheets

POLISHING AND BUFFING ATTACHMENT

BACKGROUND OF THE INVENTION

1. Field of the Invention

The present invention relates to polishing devices and more particularly pertains to a new polishing and buffing attachment for applying polish and buffing of objects, especially wheel rims.

2. Description of the Prior Art

The use of polishing devices is known in the prior art. More specifically, polishing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art polishing devices include U.S. Pat. No. 5,297,366; U.S. Pat. No. 3,362,114; U.S. Pat. No. Des. 292,834; U.S. Pat. No. 4,149,294; U.S. Pat. No. 5,224,231; and U.S. Pat. No. 729,187.

While these devices fulfill their respective, particular objectives and requirements, the aforementioned patents do not disclose a new polishing and buffing attachment. The inventive device includes a head member having a outer padded layer. The first end of an elongate shank is extended into the interior of the head member from the second end of the head member such that the second end of the shank is outwardly extended from the second end of the head member. A cover member has an interior space and opposite first and second ends. The second end of the cover member has an opening into the interior space of the cover member. The head member is insertable through the opening of the second end of the cover member into the interior space of the cover member such that the second end of the shank member extends outwards from the opening of the second end of the cover member.

In these respects, the polishing and buffing attachment according to the present invention substantially departs from the conventional concepts and designs of the prior art, and in so doing provides an apparatus primarily developed for the purpose of applying polish and buffing of objects, especially wheel rims.

SUMMARY OF THE INVENTION

In view of the foregoing disadvantages inherent in the known types of polishing devices now present in the prior art, the present invention provides a new polishing and buffing attachment construction wherein the same can be utilized for applying polish and buffing of objects, especially wheel rims.

The general purpose of the present invention, which will be described subsequently in greater detail, is to provide a new polishing and buffing attachment apparatus and method which has many of the advantages of the polishing devices mentioned heretofore and many novel features that result in a new polishing and buffing attachment which is not anticipated, rendered obvious, suggested, or even implied by any of the prior art polishing devices, either alone or in any combination thereof.

To attain this, the present invention generally comprises a head member having a outer padded layer. The first end of an elongate shank is extended into the interior of the head member from the second end of the head member such that the second end of the shank is outwardly extended from the second end of the head member. A cover member has an interior space and opposite first and second ends. The second end of the cover member has an opening into the interior space of the cover member. The head member is insertable through the opening of the second end of the cover member into the interior space of the cover member such that the second end of the shank member extends outwards from the opening of the second end of the cover member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new polishing and buffing attachment apparatus and method which has many of the advantages of the polishing devices mentioned heretofore and many novel features that result in a new polishing and buffing attachment which is not anticipated, rendered obvious, suggested, or even implied by any of the prior art polishing devices, either alone or in any combination thereof.

It is another object of the present invention to provide a new polishing and buffing attachment which may be easily and efficiently manufactured and marketed.

It is a further object of the present invention to provide a new polishing and buffing attachment which is of a durable and reliable construction.

An even further object of the present invention is to provide a new polishing and buffing attachment which is susceptible of a low cost of manufacture with regard to both materials and labor, and which accordingly is then susceptible of low prices of sale to the consuming public, thereby making such polishing and buffing attachment economically available to the buying public.

Still yet another object of the present invention is to provide a new polishing and buffing attachment which provides in the apparatuses and methods of the prior art some of the advantages thereof, while simultaneously overcoming some of the disadvantages normally associated therewith.

Still another object of the present invention is to provide a new polishing and buffing attachment for applying polish and buffing of objects, especially wheel rims.

Yet another object of the present invention is to provide a new polishing and buffing attachment which includes a head member having a outer padded layer. The first end of an elongate shank is extended into the interior of the head member from the second end of the head member such that the second end of the shank is outwardly extended from the second end of the head member. A cover member has an interior space and opposite first and second ends. The second end of the cover member has an opening into the interior space of the cover member. The head member is insertable through the opening of the second end of the cover member into the interior space of the cover member such that the second end of the shank member extends outwards from the opening of the second end of the cover member.

Still yet another object of the present invention is to provide a new polishing and buffing attachment that is mountable to rotating tool such as a drill for easy and convenient polishing of an object.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
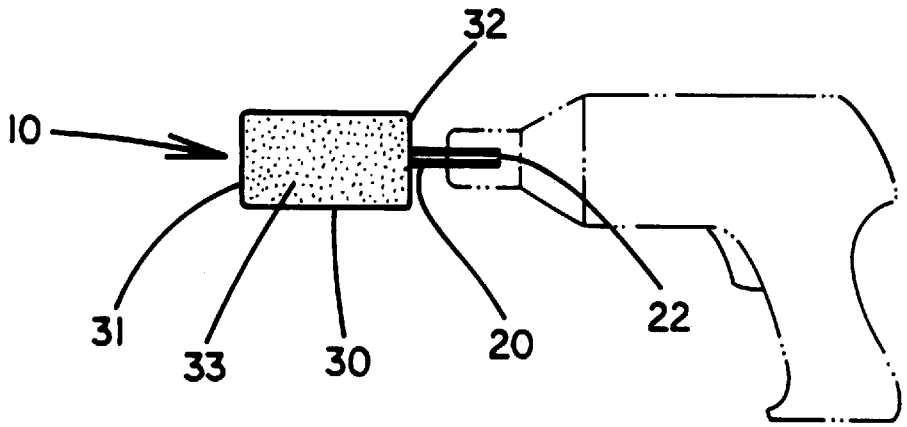
FIG. 1 is a schematic side view of a new polishing and buffing attachment in use on a drill according to the present invention.
Figure 2:
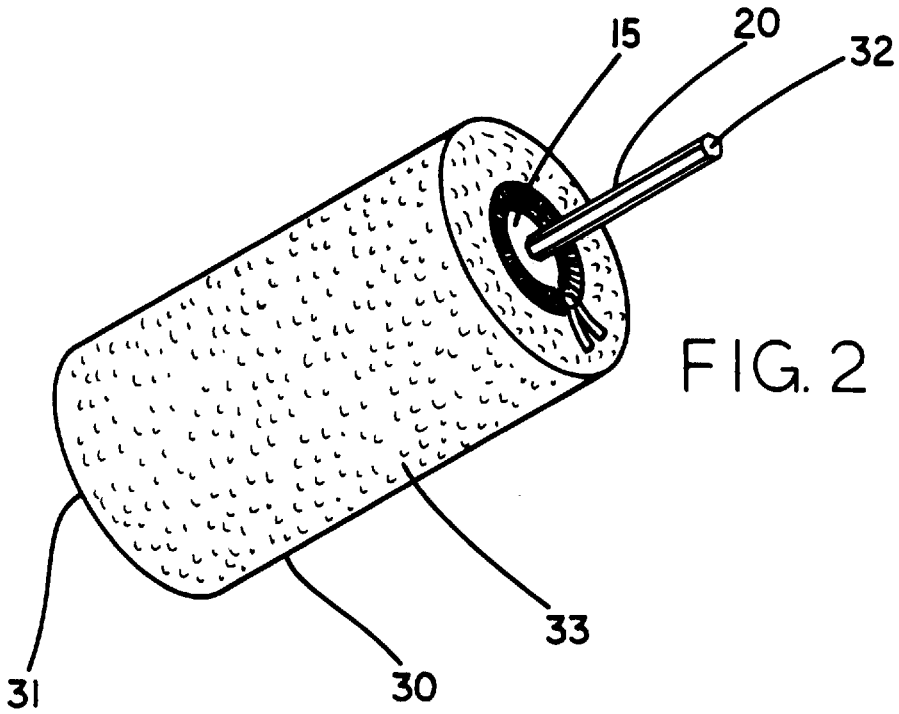
FIG. 2 is a schematic perspective view of the present invention.

With reference now to the drawings, and in particular to FIGS. 1 through 4 thereof, a new polishing and buffing attachment embodying the principles and concepts of the present invention and generally designated by the reference numeral 10 will be described.

As best illustrated in FIGS. 1 through 4, the polishing and buffing attachment 10 generally comprises a head member 12 having a outer padded layer 16. The first end 21 of an elongate shank 20 is extended into the interior 13 of the head member 12 from the second end 15 of the head member 12 such that the second end 22 of the shank 20 is outwardly extended from the second end 15 of the head member 12. A cover member 30 has an interior space 34 and opposite first and second ends 31,32. The second end 32 of the cover member 30 has an opening 35 into the interior space 34 of the cover member 30. The head member 12 is insertable through the opening 35 of the second end 32 of the cover member 30 into the interior space 34 of the cover member 30 such that the second end 22 of the shank 20 member extends outwards from the opening 35 of the second end 32 of the cover member 30.

Figure 3:
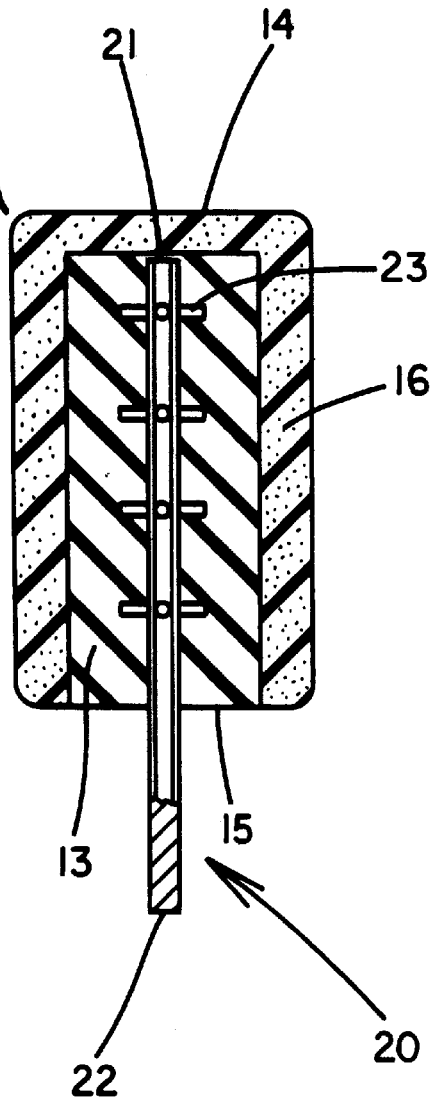
FIG. 3 is a schematic cross sectional view of the head member and shank of the present invention.

In closer detail, the a head member 12 is generally cylindrical, although optionally it may be any appropriate shape including conical. The head member 12 has an interior 13, first and second ends 14,15, a side wall, and a outer padded layer 16. The longitudinal axis of the head member 12 extends between the first and second ends of the head member 12. In the preferred cylindrical embodiment, the first and second ends 14,15 of the head member 12 are generally circular. The outer padded layer 16 ideally has thickness is generally equal to or greater than the radius of the interior 13 of the head member 12 to provide an ideal amount of padding to the head member 12. Ideally, the outer padded layer 16 comprises a resiliently compressible material, preferably, a foamed material such as a foamed rubber. As illustrated in FIG. 3, the outer padded layer 16 is preferably provided on the side wall of the head member 12 and the first end 14 of the head member 12.

Figure 4:
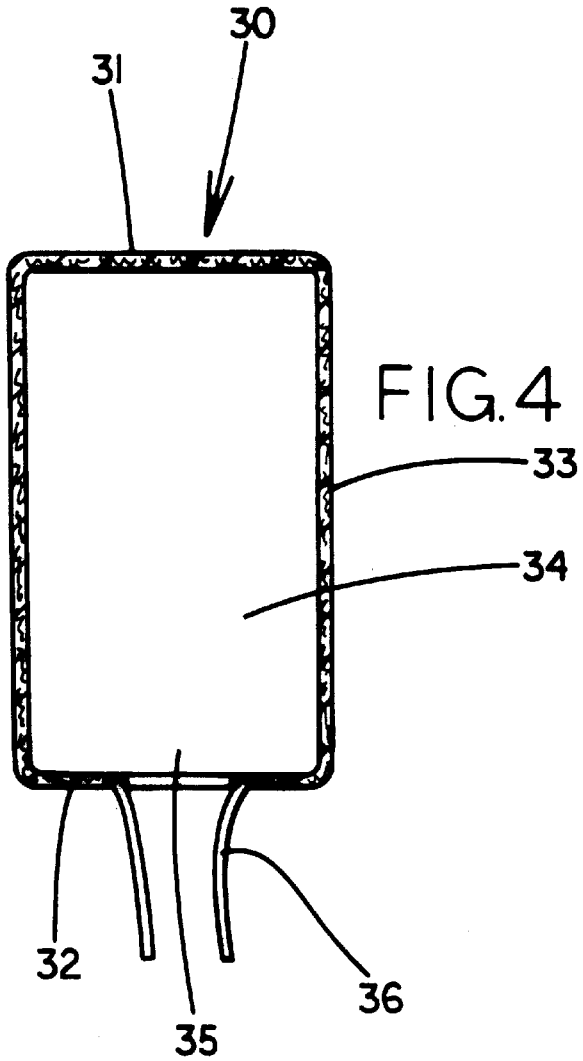
FIG. 4 is a schematic cross sectional view of the cover member of the present invention.

The elongate shank 20 has opposite first and second ends 21,22 and a longitudinal axis extending between its first and second ends 21,22. Ideally, as illustrated in FIG. 4, the shank 20 has a generally octagonal cross section taken perpendicular to the longitudinal axis of the shank 20. The first end 21 of the shank 20 is extended into the interior 13 of the head member 12 from the second end 15 of the head member 12 so that the second end 22 of the shank 20 outwardly extends from the second end 15 of the head member 12. As shown in FIG. 1, the second end 22 of the shank 20 is adapted for attachment to a rotating tool such as a drill for permitting rotation about the longitudinal axis of the shank 20 by the drill. Ideally, the longitudinal axis of the shank 20 is collinear with the longitudinal axis of the head member 12.

The shank 20 has a plurality of cross members 23 radially extending outwards from the shank 20. The cross members 23 are positioned towards the first end 21 of the shank 20 so that the cross members 23 extend into the interior 13 of the head member 12. The cross members 23 are preferably divided into a number of spaced apart sets along the length of the portion of the shank 20 in the interior 13 of the head member 12. The cross members 23 are designed for helping hold the head member 12 to the shank 20.

A cover member 30 is generally cylindrical and has an interior space 34, circular opposite first and second ends 31,32 and a perimeter side wall 33 extending between the first and second ends 31,32 of the cover member 30. Preferably, the cover member 30 comprises a flexible material such as a polishing cloth or fabric. The second end 32 of the cover member 30 has an opening 35 into the interior space 34 of the cover member 30. The head member 12 is insertable through the opening 35 of the second end 32 of the cover member 30 into the interior space 34 of the cover member 30 such that the cover member 30 substantially covers the head member 12 and so that the second end 22 of the shank 20 member extends outwards from the opening 35 of the second end 32 of the cover member 30. Preferably, the second end 32 of the cover member 30 has an elongate drawstring 36 which extends around the outer periphery of the opening 35 of the second end 32 of the cover member 30. The drawstring 36 permitting closing of opening 35 of the second end 32 of the cover member 30 around the shank 20 when the head member 12 is in the interior space 34 of the cover member 30. Optionally, an elastic flexible band may be provided around the periphery of the opening 35 to hold the cover member on the head member.

In an illustrative embodiment, the diameter of the head member 12 is less than about 3 inches with the attachment 10 having an overall a length between the first end of the head member 12 and the second end 22 of the shank 20 of less than about 8 inches.

In use, the shank 20 is attached to a rotating tool such as a drill. The cover member 30 is placed over the head member 12 and the drawstring 36 is tightened to hold the cover member 30 on the head member 12. Polish is then applied to the cover member and the attachment is rotated by the drill. The polish may then be applied to an object such as a wheel rim. The cover member 30 may be then replaced on the head member 12 by a second clean cover member so that object may be buffed to a shine by the clean cover member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A polishing and buffing attachment for mounting to a rotating tool, comprising:

a head member having an interior, first and second ends, and a outer padded layer;

said head member having a longitudinal axis being extended between said first and second ends of said head member;

an elongate shank having opposite first and second ends and a longitudinal axis extending between said first and second ends of said shank;

said first end of said shank being extended into said interior of said head member from said second end of said head member, said second end of said shank being outwardly extended from said second end of said head member;

a cover member having an interior space, opposite first and second ends and a perimeter side wall being extended between said first and second ends of said cover member;

said second end of said cover member having an opening into said interior space of said cover member, said head member being insertable through said opening of said second end of said cover member into said interior space of said cover member such that said second end of said shank member extends outwards from said opening of said second end of said cover member; and wherein said shank has a plurality of cross members being extended outwards therefrom, said cross members being positioned towards said first end of said shank, said cross members being extended into said interior of said head member.

2. The attachment of claim 1, wherein said head member is generally cylindrical, said first and second ends of said head member being generally circular.

3. The attachment of claim 1, wherein said outer padded layer comprises a resiliently compressible material.

4. The attachment of claim 3, wherein said head member comprises a foamed material.

5. The attachment of claim 1, wherein said shank has a generally octagonal cross section.

6. The attachment of claim 1, wherein said longitudinal axis of said shank is collinear with said longitudinal axis of said head member.

7. The attachment of claim 1, wherein said cover member comprising a flexible material.

8. The attachment of claim 1, wherein said opening of said second end of said cover member has an outer periphery, and wherein said second end of said cover member has an elongate drawstring being extended around said outer periphery of said opening of said second end of said cover member, said drawstring permitting closing of opening of said second end of said cover member around said shank when said head member is in said interior space of said cover member.

9. A polishing and buffing attachment for mounting to a rotating tool, comprising:

a head member being generally cylindrical and having an interior, first and second ends, and a outer padded layer, said first and second ends of said head member being generally circular;

said head member having a longitudinal axis being extended between said first and second ends of said head member;

wherein said outer padded layer comprises a resiliently compressible material, wherein said head member comprises a foamed material;

an elongate shank having opposite first and second ends and a longitudinal axis extending between said first and second ends of said shank, wherein said shank has a generally octagonal cross section;

said first end of said shank being extended into said interior of said head member from said second end of said head member, said second end of said shank being outwardly extended from said second end of said head member;

wherein said longitudinal axis of said shank is collinear with said longitudinal axis of said head member;

said shank having a plurality of cross members being radially extended outwards therefrom, said cross members being positioned towards said first end of said shank, said cross members being extended into said interior of said head member;

a cover member being generally cylindrical and having an interior space, opposite first and second ends and a perimeter side wall being extended between said first and second ends of said cover member, wherein said cover member comprising a flexible material;

said second end of said cover member having an opening into said interior space of said cover member, said head member being insertable through said opening of said second end of said cover member into said interior space of said cover member such that said second end of said shank member extends outwards from said opening of said second end of said cover member; and said opening of said second end of said cover member having an outer periphery, said second end of said cover member having an elongate drawstring being extended around said outer periphery of said opening of said second end of said cover member, said drawstring permitting closing of opening of said second end of said cover member around said shank when said head member is in said interior space of said cover member.

10. A polishing and buffing attachment for mounting to a rotating tool, comprising:

a head member having an interior, first and second ends, and a outer padded layer, said head member having a longitudinal axis being extended between said first and second ends of said head member;

an elongate shank having opposite first and second ends and a longitudinal axis extending between said first and second ends of said shank;

said first end of said shank being extended into said interior of said head member from said second end of said head member, said second end of said shank being outwardly extended from said second end of said head member;

a cover member having an interior space, opposite first and second ends and a perimeter side wall being extended between said first and second ends of said cover member;

said second end of said cover member having an opening into said interior space of said cover member, said head member being insertable through said opening of said second end of said cover member into said interior space of said cover member such that said second end of said shank member extends outwards from said opening of said second end of said cover member;

wherein said opening of said second end of said cover member has an outer periphery, and wherein said second end of said cover member has an elongate drawstring being extended around said outer periphery of said opening of said second end of said cover member, said drawstring permitting closing of opening of said second end of said cover member around said shank when said head member is in said interior space of said cover member.

11. The attachment of claim 10, wherein said head member is generally cylindrical, said first and second ends of said head member being generally circular.

12. The attachment of claim 10, wherein said outer padded layer comprises a resiliently compressible material.

13. The attachment of claim 12, wherein said head member comprises a foamed material.

14. The attachment of claim 10, wherein said shank has a generally octagonal cross section.

15. The attachment of claim 10, wherein said longitudinal axis of said shank is collinear with said longitudinal axis of said head member.

16. The attachment of claim 10, wherein said shank has a plurality of cross members being extended outwards therefrom, said cross members being positioned towards said first end of said shank, said cross members being extended into said interior of said head member.

17. The attachment of claim 10, wherein said cover member comprising a flexible material.

* * * * *